US012479641B2

(12) United States Patent
Santamaria

(10) Patent No.: US 12,479,641 B2
(45) Date of Patent: Nov. 25, 2025

(54) DEVICE FOR PROTECTING AN INNER CONTAINER

(71) Applicant: Biomedical Regenerative GF, LLC, Boca Raton, FL (US)

(72) Inventor: Claudia Santamaria, Boca Raton, FL (US)

( * ) Notice: Subject to any disclaimer, the term of this patent is extended or adjusted under 35 U.S.C. 154(b) by 121 days.

(21) Appl. No.: 16/607,641

(22) PCT Filed: May 8, 2018

(86) PCT No.: PCT/US2018/031704

§ 371 (c)(1),
(2) Date: Oct. 23, 2019

(87) PCT Pub. No.: WO2018/208863

PCT Pub. Date: Nov. 15, 2018

(65) Prior Publication Data

US 2020/0299048 A1 Sep. 24, 2020

Related U.S. Application Data

(60) Provisional application No. 62/503,219, filed on May 8, 2017.

(51) Int. Cl.

| | |
|---|---|
| ***B65D 77/04*** | (2006.01) |
| ***B65D 77/00*** | (2006.01) |
| ***B65D 81/05*** | (2006.01) |

(52) U.S. Cl.

CPC ..... *B65D 77/0493* (2013.01); *B65D 77/003* (2013.01); *B65D 81/05* (2013.01); *B65D 2581/055* (2013.01); *B65D 2581/056* (2013.01)

(58) Field of Classification Search

CPC ..... B01L 3/5082; B01L 2300/042; B01L 2200/185; B01L 3/50825; B01L 2300/0832; B65D 77/0486

USPC ..... 206/569, 828; 220/23.87, 23.89

See application file for complete search history.

(56) References Cited

U.S. PATENT DOCUMENTS 2,587,221 A * 2/1952 Richardson ..... G01N 33/743 436/128
3,017,050 A * 1/1962 Barr, Sr. ..... B01L 3/50825 D24/224
3,288,318 A * 11/1966 Corbin ..... B01L 3/5082 40/310

(Continued)

FOREIGN PATENT DOCUMENTS

WO WO-2012003873 A1 * 1/2012 ..... A61M 1/0281

*Primary Examiner* — Anthony D Stashick
*Assistant Examiner* — Prince Pal
(74) *Attorney, Agent, or Firm* — Peter A. Borsari

(57) ABSTRACT

A device for protecting an inner container and the sample or contents in the inner container. The device for protecting an inner container and sample includes an inner container and an outer protective body. The inner container can receive a sample for applications such as biomedical, health care, dentistry, agricultural, industrial, and veterinary. The inner container can be received into the outer protective body for protection. A lid secures over the inner container forming a seal to prevent leakage and contamination of the sample or inner container contents. The outer protective body is breakage-resistant for protection if the apparatus is dropped.

4 Claims, 8 Drawing Sheets

(56) References Cited

U.S. PATENT DOCUMENTS 3,419,179 A * 12/1968 Deuschle ..... B01L 3/5082 220/785
3,621,994 A * 11/1971 Brown ..... B65D 81/02 220/8
3,687,296 A * 8/1972 Spinosa ..... G01N 33/491 210/406
3,807,955 A * 4/1974 Note, Jr. ..... B01L 3/5082 422/549
3,819,081 A * 6/1974 Runte ..... B65D 41/04 206/592
3,914,985 A * 10/1975 von Behrens ..... B01L 3/5021 436/63
4,014,746 A * 3/1977 Greenspan ..... A61B 10/02 435/243
4,184,483 A * 1/1980 Greenspan ..... C12Q 1/24 435/304.2
4,278,437 A * 7/1981 Haggar ..... B01L 3/5082 422/547
4,310,488 A * 1/1982 Rahm ..... B01L 9/06 422/549
4,449,965 A * 5/1984 Strain ..... B04B 5/0414 494/16
4,459,793 A * 7/1984 Zenger ..... B65D 25/18 53/469
4,746,017 A * 5/1988 Howard ..... B65D 23/0885 604/404
4,753,358 A * 6/1988 Virca ..... B65D 55/16 215/230
4,830,217 A * 5/1989 Dufresne ..... B01L 3/5082 422/550
4,872,563 A * 10/1989 Warder ..... G21F 5/12 604/404
4,878,597 A * 11/1989 Haast ..... F26B 5/06 249/82
4,949,840 A * 8/1990 Brown ..... B65D 81/03 53/449
5,024,238 A * 6/1991 Guirguis ..... B01L 3/5082 604/404
5,029,699 A * 7/1991 Insley ..... G21F 5/08 206/443
5,108,386 A * 4/1992 Finneran ..... B01L 3/508 422/939
5,160,021 A * 11/1992 Sibley ..... B65D 81/113 220/295
5,167,455 A * 12/1992 Forman ..... B65D 33/20 383/211
5,502,981 A * 4/1996 Sullivan ..... F25D 3/08 62/372
5,511,558 A * 4/1996 Shepard ..... B01L 3/50825 600/573
5,531,966 A * 7/1996 Brouwer ..... B01L 3/505 422/549
5,545,375 A * 8/1996 Tropsha ..... C08J 7/0423 220/62.15
5,556,599 A * 9/1996 Ahmed ..... A61B 5/150389 604/404
5,654,054 A * 8/1997 Tropsha ..... C08J 7/0423 428/34.6
5,711,446 A * 1/1998 Jeffs ..... A01N 1/10 220/23.83
5,763,033 A * 6/1998 Tropsha ..... C08J 7/0423 428/447
5,791,476 A * 8/1998 Stekloff ..... B01L 9/06 206/521
5,830,154 A * 11/1998 Goldstein ..... B01L 3/5029 600/572
5,871,700 A * 2/1999 Konrad ..... B01L 9/06 422/547
5,924,594 A * 7/1999 Kelly ..... B01L 3/5082 422/549
6,017,698 A * 1/2000 Bienhaus ..... B01L 3/5082 422/534
6,066,299 A * 5/2000 Lodge ..... B01L 3/5082 422/547
6,077,235 A * 6/2000 Serpentino ..... A61B 5/150732 600/573
6,221,307 B1 * 4/2001 Hutton ..... B01L 3/5082 264/572
6,354,452 B1 * 3/2002 DeSalvo ..... B01L 3/5082 220/592.2
6,361,746 B1 * 3/2002 Wlodarski ..... B01L 7/00 422/561
6,534,016 B1 * 3/2003 Cohen ..... B01L 3/5082 424/44
6,651,835 B2 * 11/2003 Iskra ..... B01L 3/5082 220/592.2
6,749,078 B2 * 6/2004 Iskra ..... B01L 3/5082 220/592.2
6,821,785 B1 * 11/2004 Anraku ..... A61B 5/150732 436/66
7,152,736 B1 * 12/2006 Menichini ..... B01L 9/06 422/534
7,507,378 B2 * 3/2009 Reichenbach ..... B01L 3/5082 422/562
7,578,977 B2 * 8/2009 Swenson ..... B01L 3/5082 422/513
7,959,866 B2 * 6/2011 Crawford ..... B01L 3/5082 422/550
8,287,821 B2 * 10/2012 Nakahana ..... B01L 3/5082 422/550
8,460,620 B2 * 6/2013 Bartfeld ..... B01L 3/50825 422/549
8,685,748 B2 * 4/2014 Lloyd, Jr. ..... C12M 45/22 436/178
9,561,895 B1 * 2/2017 Kammer ..... A61F 7/00
9,868,252 B2 * 1/2018 Reichenbach ..... B29C 65/565
2001/0008614 A1 * 7/2001 Aronowitz ..... A61J 1/05 436/178
2002/0011492 A1 * 1/2002 Iskra ..... B01L 3/5082 220/23.87
2002/0088723 A1 * 7/2002 Lowry ..... B65D 81/264 206/204
2002/0104840 A1 * 8/2002 Iskra ..... B01L 3/5082 220/23.87
2002/0124591 A1 * 9/2002 Gano, III ..... B65D 77/0486 62/457.5
2003/0045857 A1 * 3/2003 Dubrowny ..... A61B 5/150755 604/416
2003/0133844 A1 * 7/2003 Conway ..... B01L 3/50825 422/400
2004/0013574 A1 * 1/2004 Conway ..... B01L 3/5082 422/400
2004/0026353 A1 * 2/2004 Collins ..... B01L 3/50825 215/355
2004/0159568 A1 * 8/2004 Rutledge ..... B65D 81/18 206/438
2004/0179971 A1 * 9/2004 Ferguson ..... B01L 9/06 422/400
2004/0223889 A1 * 11/2004 Reichenbach ..... B29C 66/545 29/455.1
2005/0042144 A1 * 2/2005 Hubbard ..... B01L 7/04 422/400
2005/0187533 A1 * 8/2005 Filler ..... B01L 3/50825 604/403
2006/0021673 A1 * 2/2006 Rodewald ..... B65B 7/2835 141/127
2006/0147352 A1 * 7/2006 Ulin ..... H05B 6/806 422/400
2006/0226113 A1 * 10/2006 Clark ..... B65D 51/002 215/247
2007/0036686 A1 * 2/2007 Hatamian ..... B01L 3/5021 422/400
2008/0125673 A1 * 5/2008 Carano ..... A61B 5/150351 600/584
2008/0134806 A1 * 6/2008 Capriccio ..... G01N 1/38 422/400
2009/0202394 A1 * 8/2009 Nguyen ..... B01L 3/5082 422/400

(56) References Cited

U.S. PATENT DOCUMENTS

2009/0281516 A1* 11/2009 Ahern ..... B01L 3/5082 604/415
2011/0044867 A1* 2/2011 Cefaratti ..... B01L 3/50825 422/550
2011/0062043 A1* 3/2011 Bougoulas ..... B65D 1/26 206/514
2011/0130740 A1* 6/2011 Levy ..... A61J 7/0053 604/403
2012/0048827 A1* 3/2012 Levin ..... B01L 3/5082 215/382
2012/0141341 A1* 6/2012 Bartfeld ..... B01L 3/50825 422/549
2013/0064736 A1* 3/2013 Daf ..... B01L 3/5082 422/500
2013/0225387 A1* 8/2013 Hirai ..... B04B 7/08 494/37
2015/0051383 A1* 2/2015 Doucette ..... B01L 3/5021 422/534
2015/0076069 A1* 3/2015 Ellis ..... B01L 3/502 210/663
2015/0211966 A1* 7/2015 Hsu ..... G01N 1/34 435/307.1
2016/0023833 A1* 1/2016 Hallab ..... B65D 81/022 220/592.27
2016/0097049 A1* 4/2016 Qian ..... C12N 15/1017 422/534
2016/0167845 A1* 6/2016 Harvey ..... B65D 50/041 220/23.91
2016/0274004 A1* 9/2016 Roederer ..... C12Q 1/02
2016/0341641 A1* 11/2016 Williams ..... B01L 3/5021
2017/0020783 A1* 1/2017 Shani ..... B65D 77/0493
2017/0023546 A1* 1/2017 Holmes ..... A61B 5/150343
2017/0043346 A1* 2/2017 Welch ..... B65D 25/24
2017/0102299 A1* 4/2017 Laugharn, Jr. ..... G01N 1/405
2017/0246625 A1* 8/2017 Becker ..... A61B 10/0096
2017/0258683 A1* 9/2017 Tsakas ..... B65B 63/08
2017/0265625 A1* 9/2017 Thorpe ..... A45D 33/006
2018/0244453 A1* 8/2018 Bannas ..... B65D 77/0486
2018/0311662 A1* 11/2018 Sams ..... B01L 3/5021
2019/0308789 A1* 10/2019 Shea ..... B65D 81/2015
2019/0308864 A1* 10/2019 Fedoruk ..... B01L 3/508
2019/0329248 A1* 10/2019 Scherrer ..... B01L 3/5082
2019/0350508 A1* 11/2019 Noguchi ..... B01L 3/5635
2020/0045986 A1* 2/2020 Barr ..... B65D 77/24
2020/0299048 A1* 9/2020 Santamaria ..... B65D 77/0493
2020/0397418 A1* 12/2020 Williams ..... B01L 3/50825
2021/0094743 A1* 4/2021 Donschietz ..... A61J 1/065
2021/0156768 A1* 5/2021 Psyllaki ..... G01N 1/405
2021/0371172 A1* 12/2021 Markarian ..... B65D 59/04

* cited by examiner

DEVICE FOR PROTECTING AN INNER CONTAINER

CROSS REFERENCE TO RELATED APPLICATION

This application claims priority to and the benefit of U.S. provisional application No. 62/503,219, filed on May 8, 2017 in its entirety. This application is the national stage application from international application number PCT/US2018/031704, having an international filing date of May 8, 2018 and which claims priority to U.S. provisional application No. 62/503,219.

FIELD OF THE DISCLOSURE

The present disclosure relates to health care equipment and devices for protecting inner containers. More specifically, the present disclosure relates to devices for protecting containers capable of holding fluid specimens for storage, analysis, or processing in medical, pharmaceutical, clinical, forensic, dental, industrial, agricultural, environmental, and veterinary applications.

BACKGROUND OF THE DISCLOSURE

In the biomedical science and health care industries in particular, blood is drawn for various tests to assess an animal's health. Test tubes or storing, transporting, and processing blood may have an additive for either promoting or inhibiting clotting, depending on the intended application. From the blood sample, the intended application may require the testing or processing of serum or plasma. To accomplish this, the blood is disposed in a test tube with an additive.

Modern blood collection tubes and test tubes are made from plastic, requiring treatment with an additive, especially in applications requiring centrifugation to obtain a serum or plasma supernatant. Plastic is almost exclusively used due to the risks that glass test and blood collection tubes pose: breakage, contamination of the sample, contamination of the laboratory, contamination and injury of the personnel handling the sample, and the spread of blood-borne pathogens and diseases. The test and blood collection tube materials, additives, and specifications are therefore regulated by governing agencies such as the U.S. Food and Drug Administration which generally requires the use of plastic test and blood collection tubes.

Traditionally, blood collection tubes were made out of glass, particularly in the mid 1900's. Glass tubes did not require a clotting additive because the silica in glass already promoted clotting. The blood cells and platelets would coagulate, and during centrifugation would fall to the bottom of the tube, leaving a supernatant of serum or plasma.

Glass test tubes and blood collection tubes are ideal for biomedical and health care applications requiring the retrieval of plasma or serum. Newer regenerative treatments with platelet-rich plasma and platelet-rich fibrin for example require drawing a person's blood, spinning the sample down in a centrifuge, retrieving a supernatant, and treating the person with the supernatant that may or may not be further processed. These applications are distinguished from drawing blood merely for in vitro health screenings because part of the sample (the supernatant containing plasma or serum that is platelet rich) is returned to the person's body.

In a particular example, platelet-rich fibrin applications in dental procedures is becoming increasingly popular due to expedited healing. Other applications include hair loss, wrinkle and antiaging, and orthopedic treatments. These treatments typically require multiple sessions. Multiple sessions also means greater exposure to additives from plastic tubes.

Plastic test tubes are generally treated with silicones and silicas. Inhalation and internal exposure to silicas can result in fibroids and subsequently cancer. Exposure to the additives likely poses an industrial occupational hazard for those in the manufacturing sector. People receiving treatments with their own serum or plasma are exposed to additive residue, sometimes directly into the bloodstream if the serum or plasma is injected or topically applied to an open wound or suture. Furthermore, hormone disruptors such as bisphenol A can leach from the plastic in to the sample and supernatant to be used in treatment.

Accordingly, sample exposure to additives as inherently occurring with plastic tubes should be avoided or eliminated while still conforming to government regulations.

SUMMARY OF THE DISCLOSURE

What is needed is a cost-effective durable device to be used in connection with a breakable inner container at least partially filled with a sample. A device generally comprises an inner container housed in the cavity of an outer protective body. The outer protective body may be fixably or removably attached to the inner container.

The inner container is capable of holding a sample which may be a bodily fluid such as blood or serum, a soil or water sample, a pharmaceutical preparation, or a nutritional product. The inner container is configured to fit inside an internal cavity defined by the outer protective body.

A lid prevents contamination or expulsion of a sample disposed within the inner container. The lid is configured to be securable upon the upper end of the outer protective body while providing a vacuum seal as well as positional stabilization for the inner container. The lid is configured to be frictionally secured over the upper end of the outer protective body. The frictional security provides enhanced stability and contamination prevention for the device for protecting an inner container.

The outer protective body has a ledge disposed at an upper end thereof. The ledge is configured to securely receive the lid thereon. This embodiment provides an efficient manner of holding the lid on the device for protecting an inner container and sample. A strap can be implemented to secure an inner container with its own lid or cap where the outer protective body does not receive the lid or cap thereon.

The device may be presented in a sterile pack for single or multi use after autoclaving. Multiple devices may be presented in a single sterile pack and may be configured according to the intended application. For example, specialized packs may be configured for platelet-rich fibrin applications in dental and oral surgical procedures.

BRIEF DESCRIPTION OF THE DRAWINGS

The accompanying drawings, that are incorporated in and constitute a part of this specification, illustrate several embodiments of the disclosure and, together with the description, serve to explain the principles of the disclosure.

REFERENCE NUMERALS OF THE DRAWINGS

Figure 1:
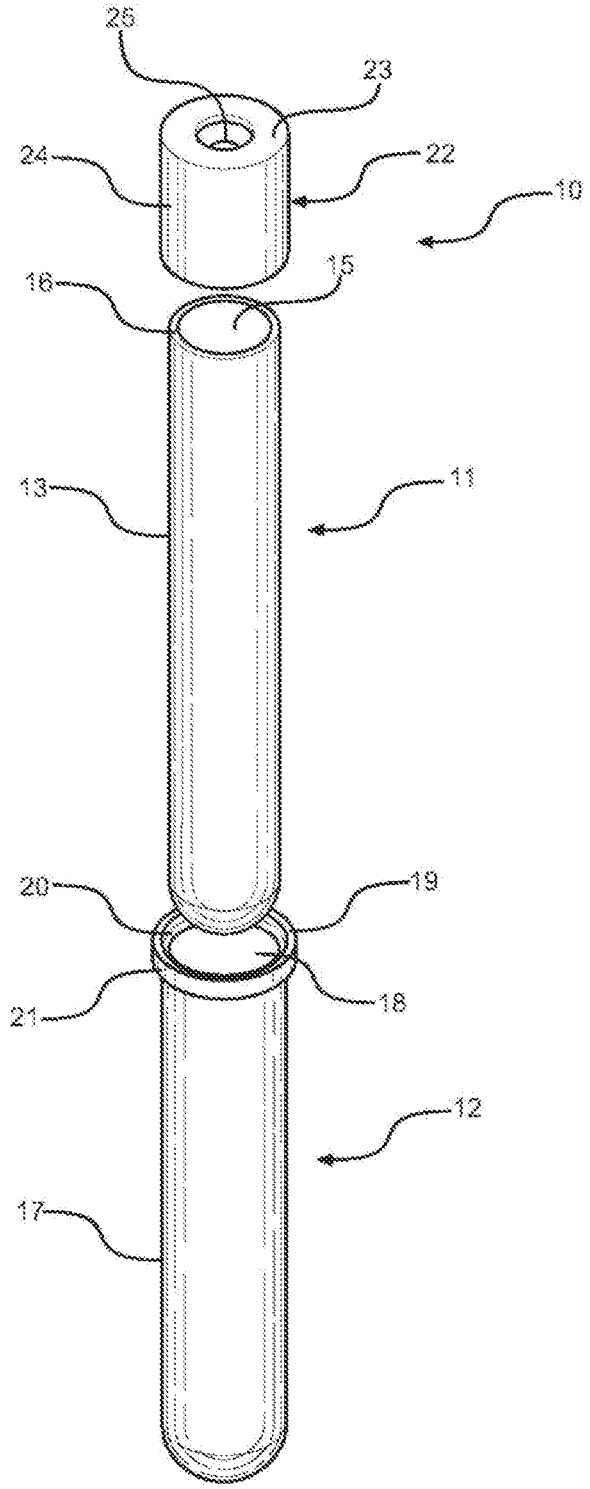
FIG. 1 shows an exploded view of an exemplary device for protecting an inner container.

10 device
11 inner container
12 outer protective body
13 housing
14 internal cavity
15 open end
16 rim
17 elongated tubular housing
18 open upper end
19 lip
20 ledge
21 wall
22 lid
23 base
24 receptacle
25 cap
26 first seal
27 second seal
28 strap
29 ridge
30 connection point
32 fastener
33 sterilized housing
34 void
40 strap
41 fastener
42 closed end

DETAILED DESCRIPTION

The present disclosure provides generally for a device for protecting an inner container, especially for use in industries such as biomedical science, health care, dentistry, agriculture, industrial, and veterinary health and wellness.

According to the present disclosure, a device generally comprises an inner container housed in the cavity of an outer protective body. The outer protective body may be fixably or removably attached to the inner container. The inner container is capable of holding a sample which may be bodily fluid such as blood or serum, a soil or water sample, a pharmaceutical preparation, or a nutritional product.

In preferred embodiments, the inner container is made of a glass such as borosilicate for example, and the outer protective body is made out of a molded or extruded plastic such as polyethylene terephthalate ("PET"). In preferred embodiments, the outer protective body is translucent or transparent to allow visibility of the sample in the inner container. The glass inner container provides compatibility with the sample for storage and processing while the plastic outer protective body prevents breakage of the inner container and destruction and contamination of the sample.

In preferred embodiments, the outer protective body may be removed and autoclaved for interchangeable or recycled use. However, in some embodiments, the outer protective body may be fixably attached to an inner container for single use. The protective body is preferably configured to fit in standard centrifuges and test tube holders.

In preferred embodiments and under sterile conditions, a lid and/or a cap applied will create a vacuum seal yet provide penetration of a needle into the inner container to retrieve a sample. The sample may then be further processed, applied to or within an animal's body, or used for in vitro experimentation.

Specialized sterile packs may be customized according to the intended application. For example, dental and oral surgery procedures using platelet-rich fibrin may require one to six devices in a sterile pack for single use whereas environmental applications may require a pack of twelve tubes for various sample sites.

Preferably, the device should be treated like any other collection or test tube with safety precautions such as placing the device in a holder when not in use or when placing an inner container, cap, lid, or strap on or into the device's outer container.

A sample may comprise a solid, liquid, or gas. A sample may be deposited into the inner container before or after the inner container is inserted into the outer container or protective body if the outer protective body is removably attached.

In the following sections, detailed descriptions of examples and methods of the disclosure will be given. The description of both preferred and alternative examples are exemplary only, and it is understood that to those skilled in the art that variations, modifications, and alterations may be apparent. It is therefore to be understood that the examples do not limit the broadness of the aspects of the underlying disclosure as defined by the claims.

Referring to FIG. 1, an exploded view of an exemplary device for protecting an inner container is shown. The device for protecting an inner container 10 ("the device") comprises an inner container 11 and an outer protective body 12. In the shown embodiment, the inner container 11 comprises an elongated tubular housing 13 defining an internal cavity 14 therein with an open end 15 disposed oppositely a closed lower end. The lower end is of any suitable shape. Additionally, in the illustrated embodiment, the closed lower end is rounded. The open upper end 15 is defined by a rim 16.

Furthermore, the inner container 11 is configured to receive a biological, medical, fluids, food or chemical sample therein. The inner container 11 is made of a non-contaminating material. In one embodiment, the inner container 11 is made of glass. When using glass, blood coagulation is promoted in the cavity 14 wherein the biological, medical or chemical sample is a blood sample.

In another embodiment, the inner container 11 further comprises at least one additive, such as an SFS coating, a gel, a clot activator, a separator or an anticoagulant compound. In another embodiment, the inner container 11 is vacuum-sealed by a cap 25 which may secure a lid 22 or be independent therefrom depending on the type of inner container used such as a standard tube or a vacuum sealed tube. The inner container 11 may be any container configured to receive a sample therein.

In one embodiment, the inner container is configured to be processed in a centrifuge when assembled with the outer protective body 12. In another embodiment, the inner container is configured to be used in the manufacture of platelet rich fibrin (PRF). In yet another embodiment, the inner container is configured to be used in In Vitro Diagnostic (IVD) tests. In another embodiment, the outer protective body 12 comprises an elongated tubular housing 17 defining a cavity therein with an open upper end 18. The open upper end 18 is defined by a lip 19.

The outer protective body 12 is configured to house the inner container 11 therein. The outer protective body 12 is configured to prevent breakage of the inner container 11. The outer protective body 12 is made of a shatter-resistant material, such as polyethylene terephthalate (PET), plastic, latex, ceramic, fiberglass, metal, flexi-glass, rubber, melamine, tempered glass, polypropylene, carton, glazed stoneware, metallic glass, or a combination of the above materials. The outer protective body 12 is further configured to be shock-resistant, meaning that the outer protective body 12 can sustain an impact without damage to an internal component, such as the inner container 11 or the biological, medical or chemical sample disposed therein, and liquids and food or other consumable sample. In one embodiment, the inner container 11 is longer in length, from the rim to the bottom, than the outer protective body 12, such that a portion of the inner container 11 extends above the lip 19 of the outer protective body 12. The lip 19 defines a ledge 20 with a wall 21 extending upward therefrom. When the device for protecting a sample 10 is placed in a vertical position, the ledge 20 is oriented on a horizontal axis and the wall 21 is oriented on a vertical axis. The outer protective body 12 is sized to receive the inner container 11 in the cavity thereof For example, the outer protective body may be 15 centimeters long and the inner container may be 10 or 12 centimeters long. In another example, the outer protective body and the inner container may be the same length. Conventional sizes and shapes may be implemented.

Figure 2:
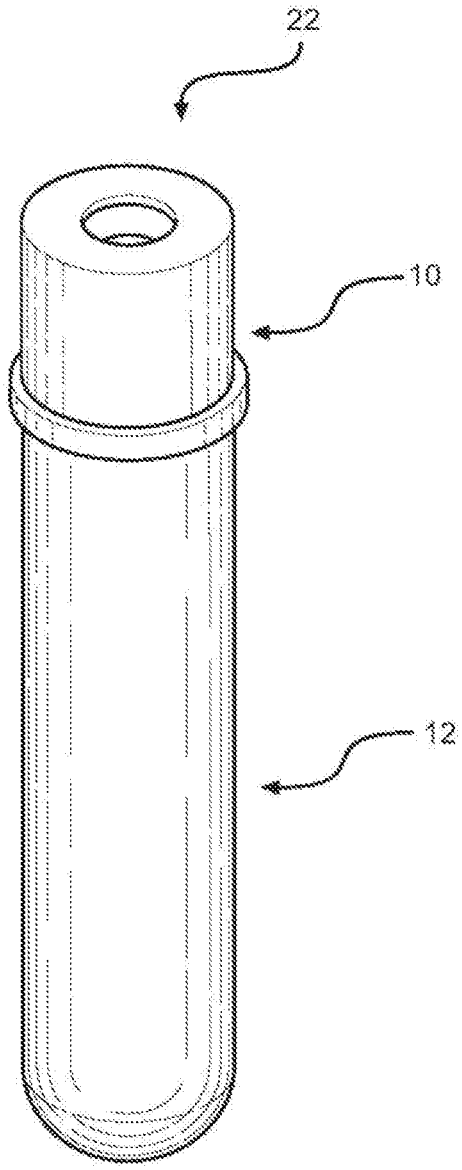
FIG. 2 shows a perspective view of an exemplary device for protecting an inner container.

Referring to FIG. 2, a perspective view of an exemplary device for protecting an inner container is shown. The device for protecting an inner container 10 is configured to be arranged in a containment position and an open position. The containment position is defined where the inner container is removably disposed within the outer protective body 12. Furthermore, in the containment position, the lid 22 is engaged upon the outer protective body 12, such as to ensure that the biological, medical or chemical sample will not leak in the unlikely yet possible event the inner container breaks.

Figure 3:
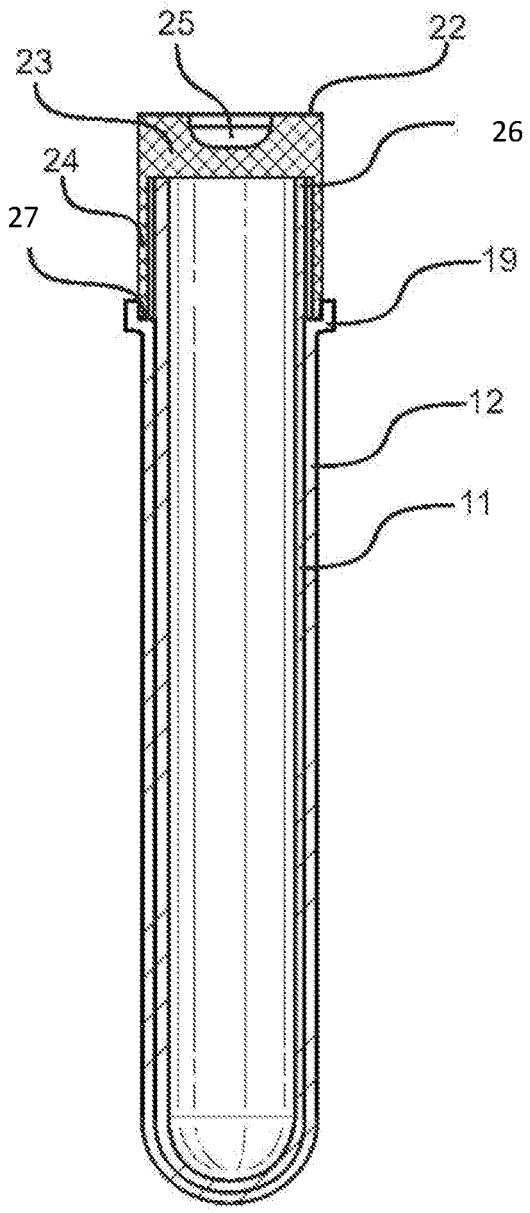
FIG. 3 shows a side sectional view of an exemplary device for protecting an inner container.

Referring to FIG. 3, a side sectional view of an exemplary device for protecting an inner container is shown. The outer protective body 12 comprises an interface configured to receive a cap 25. Under the shown embodiment, the cap 25, or alternatively a lid 22 depending on configuration, may attach to the outer protective body 12 and aligns with the lip 19 disposed on an upper portion of the outer protective body 12. This embodiment ensures that fluid will not escape from the cavity of the inner container 1 as a first seal 26 is formed between the inner container 11 and an internal side of the base 23 of the lid 25. Additionally, a second seal 27 is formed between the outer protective body 12 and the cap 25 or lid 22 at the lip 19.

In the illustrated embodiment, the lid 22 is vertically lower than the periphery of the cap 25 disposed around the lid 22. Under this embodiment, the indent is easier to locate and is easier to penetrate with a needle. Alternatively and depending on the configuration of the inner container, the cap 25 may be vertically lower than the lid 22. Clearances may be by 0.2 mm to 2 cm for example.

Figure 4:
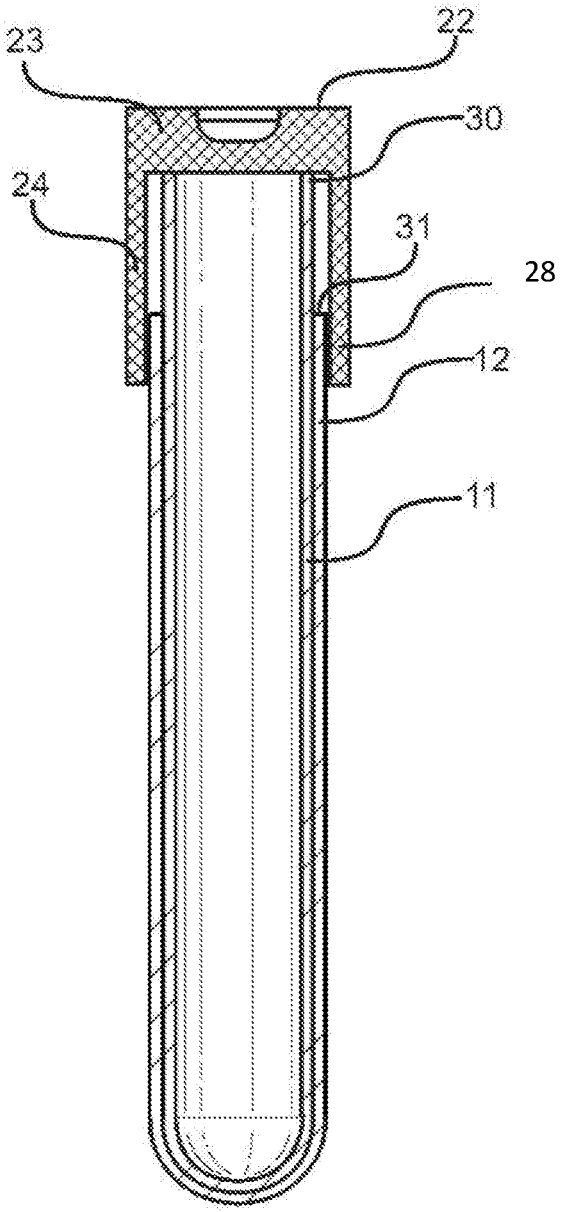
FIG. 4 shows an additional side sectional view of an exemplary device for protecting an inner container.

Referring to FIG. 4, an additional side sectional view of an exemplary device for protecting an inner container is shown. Under the shown embodiment, the lid is frictionally secured to the device for protecting a sample. A first seal 26 is frictionally formed between the inner container 11 and the base 23 of the lid 22. Additionally, a second seal 27 is frictionally formed between the outer protective body 12 and an overlapping portion 40 of the receptacle 24 of the lid 22.

Figure 5:
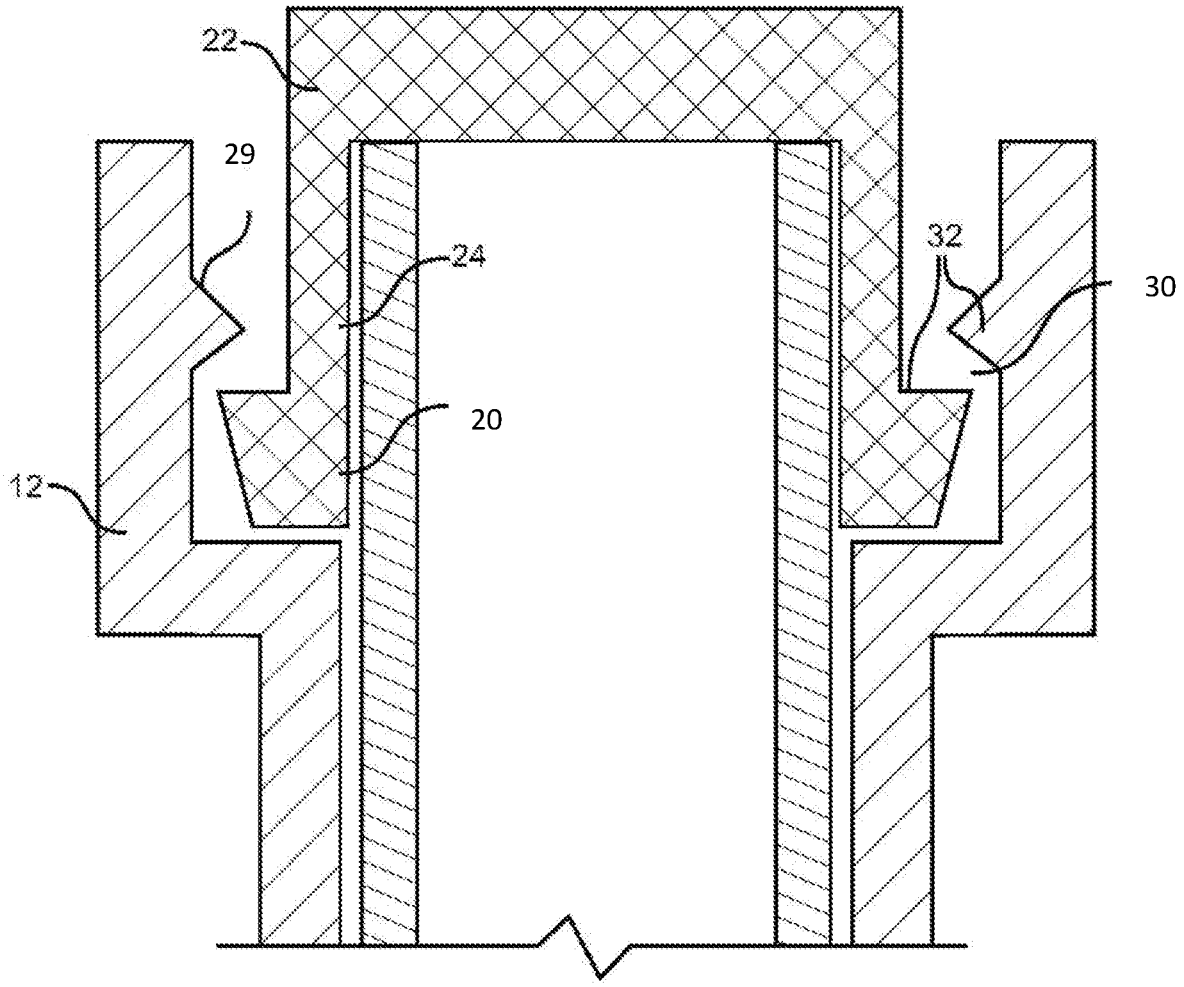
FIG. 5 shows an enlarged side sectional view of an open end of an exemplary device for protecting an inner container.

Referring to FIG. 5, an enlarged side sectional view of an open end of an exemplary device for protecting an inner container is shown. In one embodiment, the device for protecting a sample comprises a fastener 32 disposed between the connection point 30 of the lid 22 and the outer protective body 12.

In the illustrated embodiment, the fastener comprises a ridge 29 and a ledge 20. The ridge 29 is disposed on the internal surface of the outer protective body 12. The ledge 20 is disposed on the external surface of the receptacle 24. When the device for protecting a sample is placed into a locked position, the ledge 20 will pass under the ridge 29, such that the lid will be frictionally secured to the outer protective body 12.

Figure 6:
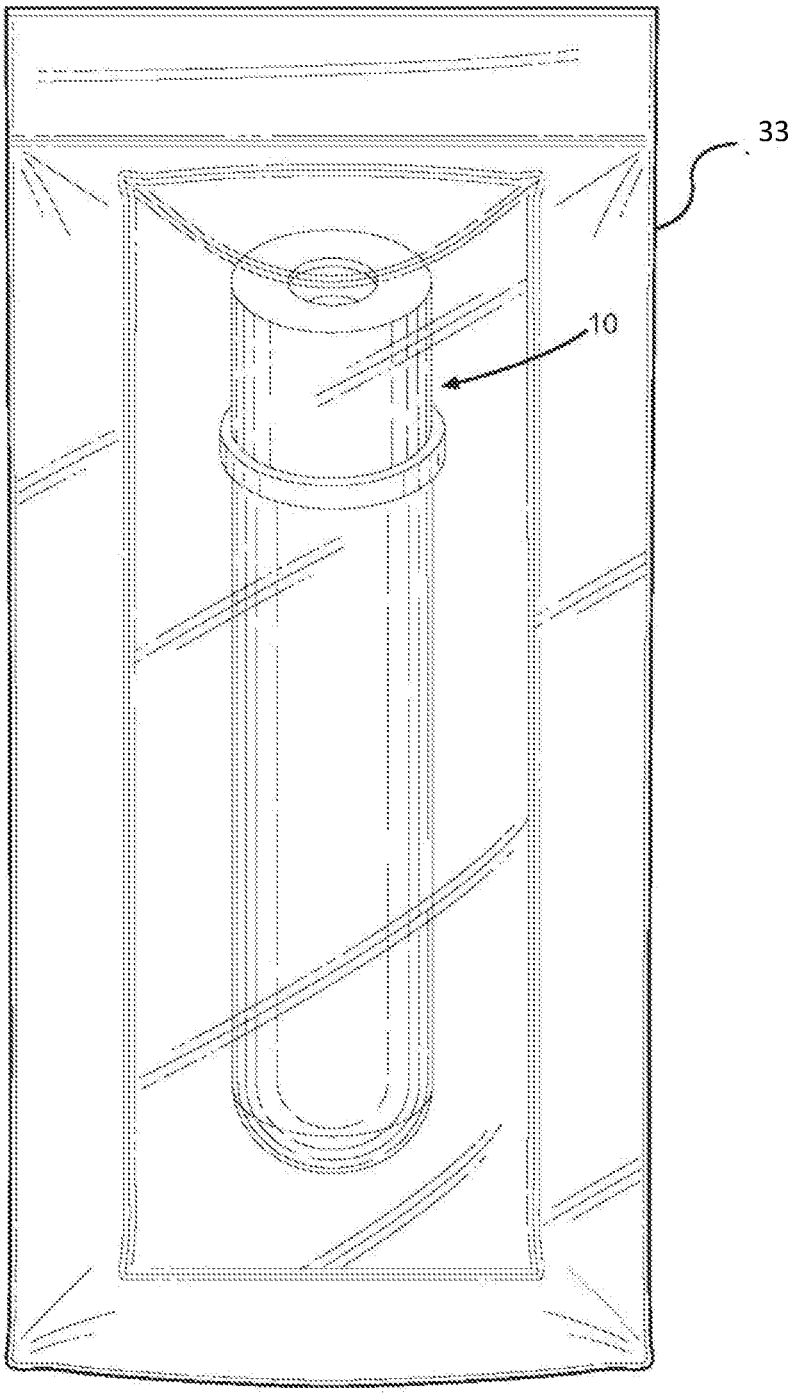
FIG. 6 shows a perspective view of an exemplary device for protecting an inner container in a sterile pack.

Referring to FIG. 6, a perspective view of an exemplary device for protecting an inner container in a sterile pack is shown. In one embodiment, the sterilized housing 33 is configured to receive the inner container, the outer protective body and the lid therein. By packaging the device for protecting a sample 10 in the sterilized housing 33, it is ensured that the device for protecting a sample will be sterile when used. In the illustrated embodiment, the sterilized housing 33 is transparent. The sterilized housing 33 is made of any suitable material, such as plastic.

Figure 7:
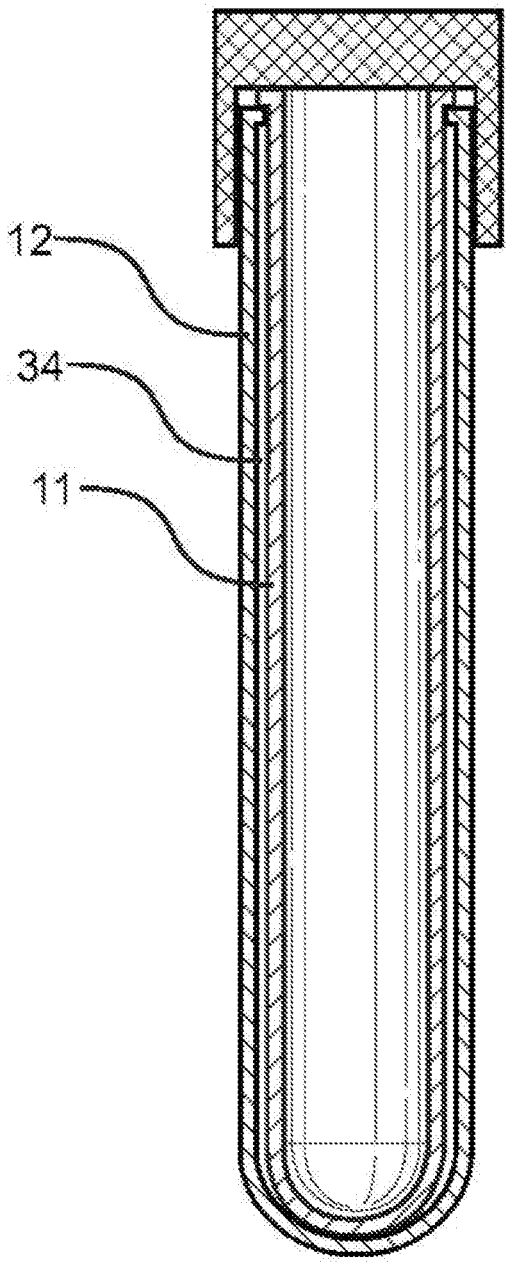
FIG. 7 shows a side sectional view of an exemplary device for protecting an inner container.

Referring to FIG. 7, a side sectional view of an exemplary device for protecting an inner container is shown. In one embodiment, a void 34 is defined between the inner container 11 and the outer protective body 12. The void 34 may be of any desired size. In one embodiment, the space 34 extends entirely between the inner container 11 and the outer protective body 12. In another embodiment, the void 34 is at least partially filled with a solid, a liquid or a gas.

Figure 8:
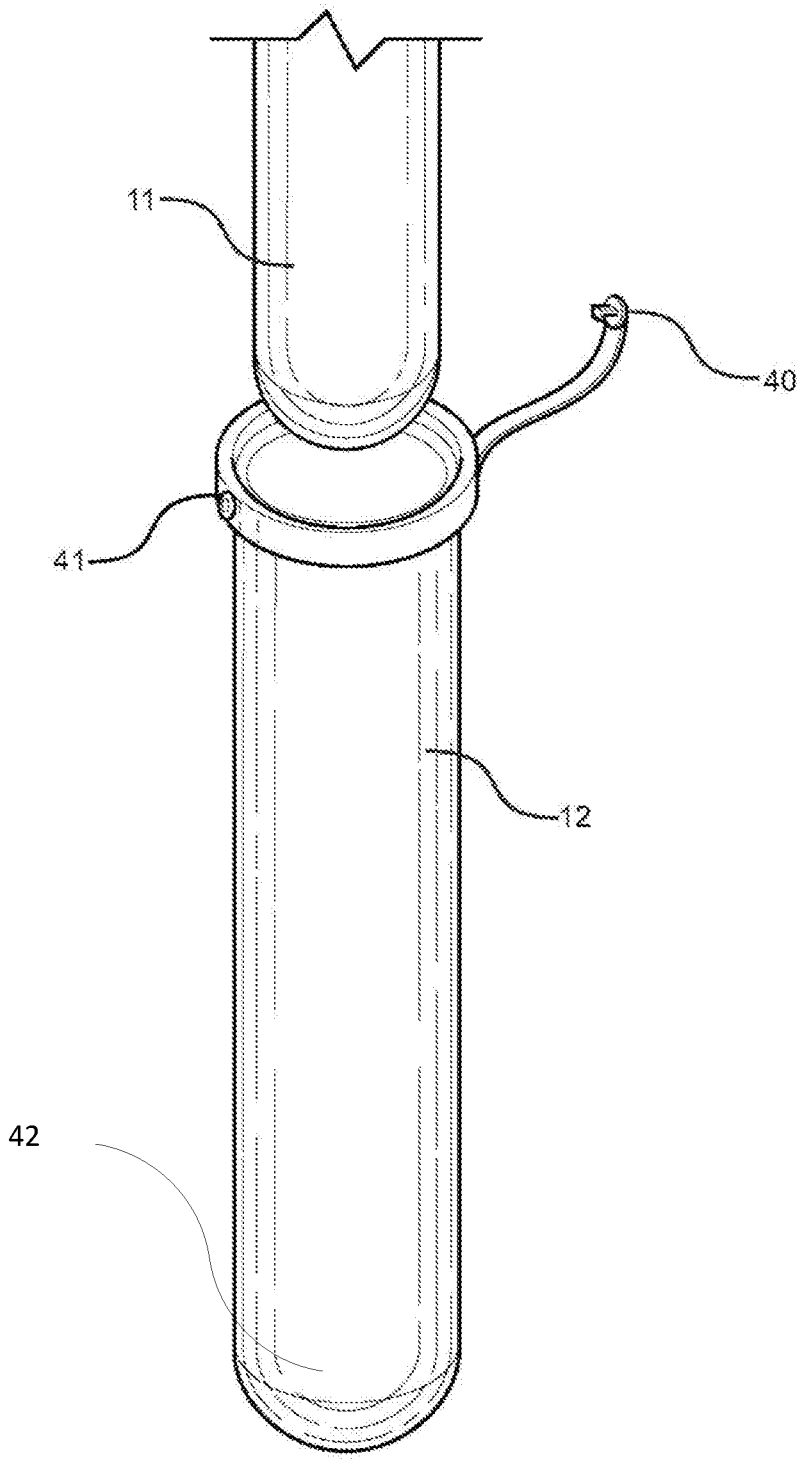
FIG. 8 shows an exploded view of an exemplary device for protecting an inner container with a strap.

Referring to FIG. 8 an exploded view of an exemplary device for protecting an inner container with a strap is shown. Under the shown embodiment, the outer protective body 12 comprises a strap 40 disposed on an end thereof, preferably opposite a closed end 42. The strap 40 is configured to interact with a fastener 41, such that the inner container 11 can be secured in the outer protective body 12 by the strap. This configuration allows for a greater variety of inner containers to be used with the device. The device's outer body may be made from a material selected from the group consisting of polyethylene terephthalate, plastic, latex, ceramic, fiberglass, metal and any breakage-resistant material.

The device may be used with inner containers made from glass, ceramic, porcelain, plastics and may also have additives such as SFS, a coating, a gel, a clot activator, a surfactant, a separator, or an anticoagulant compound.

A number of embodiments of the present disclosure have been described. While this specification contains many specific implementation details, there should not be construed as limitations on the scope of any disclosures or of what may be claimed, but rather as descriptions of features specific to particular embodiments of the present disclosure.

Certain features that are described in this specification in the context of separate embodiments can also be implemented in combination in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Thus, particular embodiments of the subject matter have been described. Other embodiments are within the scope of the following claims. In some cases, the actions recited in the claims can be performed in a different order and still achieve desirable results. Nevertheless, it will be understood that various modifications may be made without departing from the spirit and scope of the claimed disclosure.

What is claimed is:

1. A device for protecting an inner container made of glass and suitable for use in a centrifuge, the device comprising:

a. an outer protective body composed of a plastic material and in the form of an elongated tubular housing having a closed lower end, a tubular inner cavity, and an open upper end, said open upper end having a lip with a ledge oriented on a horizontal axis and a wall oriented on a vertical axis extending upwardly from said lip;

b. an inner container composed of glass material and suitable for use in a centrifuge, said inner container being in the form of an elongated tube having a closed bottom end, an inner cavity having an interior volume, and an open top end, said open top end defined by a rim, said elongated tube having a vertical length which is greater than the vertical length of said elongated tubular housing such that said open top end defined by a rim extends above said lip of said outer protective container;

c. a cap member capable of being punctured with a needle, said cap member cooperatively engaging with said rim of said top end of said inner container and not extending into said outer protective body and d. a lid member which is lower vertically than the periphery of said cap member, said lid member having an upper surface, a base extending downwardly from said upper surface to form a receptacle element, said base having an internal side, said lid member cooperatively engaging with said lip member of said outer protective body, wherein said inner container is disposed within said internal cavity of said outer protective body and said interior volume within said inner container is vacuum sealed by cooperatively engaging said cap member with said rim of said top end of said inner container, concentrically forming a first seal between said inner container and said internal side of said base, cooperatively engaging said lid member with said outer protective body to concentrically form a second seal between said lip of said outer protective body and said lid member by aligning said internal side of said base with said wall extending upwardly from said ledge of said lip of said outer protective body, and, wherein when said inner container is vacuum sealed, said inner container retains and isolates a fluid contained therein and prevents escape of a fluid contained therein from said inner container to said outer protective body, and wherein said outer protective body prevents breakage of said inner container.

2. The device according to claim 1, wherein the inner container is used for the separation of platelet rich fibrin clot.

3. The device according to claim 1, wherein said outer protective body is composed of a shatter-resistant material.

4. The device according to claim 3, wherein said shatter-resistant material is polyethylene terephthalate (PET).

* * * * *